US011137210B2

(12) United States Patent
Holmes

(10) Patent No.: US 11,137,210 B2
(45) Date of Patent: Oct. 5, 2021

(54) HEAT EXCHANGER

(71) Applicant: DENSO International America, Inc., Southfield, MI (US)

(72) Inventor: Mark Holmes, Troy, MI (US)

(73) Assignee: DENSO International America, Inc., Southfield, MI (US)

( * ) Notice: Subject to any disclaimer, the term of this patent is extended or adjusted under 35 U.S.C. 154(b) by 190 days.

(21) Appl. No.: 16/534,531

(22) Filed: Aug. 7, 2019

(65) Prior Publication Data

US 2021/0041177 A1 Feb. 11, 2021

(51) Int. Cl.

| | |
|---|---|
| ***F28D 1/02*** | (2006.01) |
| ***F28D 1/053*** | (2006.01) |
| ***F28F 1/14*** | (2006.01) |
| ***F28F 1/24*** | (2006.01) |
| ***F28F 1/12*** | (2006.01) |

(52) U.S. Cl.

CPC ..... *F28D 1/0233* (2013.01); *F28D 1/05308* (2013.01); *F28F 1/128* (2013.01); *F28F 1/14* (2013.01); *F28F 1/24* (2013.01); *F28F 2265/26* (2013.01)

(58) Field of Classification Search

CPC ... F28F 2265/26; F28F 9/0224; F28D 1/0233; F28D 1/05308; F28D 1/05366

See application file for complete search history.

(56) References Cited

U.S. PATENT DOCUMENTS

| | | | | |
|---|---|---|---|---|
| 5,311,933 | A * | 5/1994 | Lee | F28F 9/0226 165/149 |
| 5,758,721 | A * | 6/1998 | Letrange | F28F 9/0226 165/173 |
| 5,944,095 | A * | 8/1999 | Fukuoka | F28F 9/0224 165/173 |
| 6,412,547 | B1 | 7/2002 | Siler | |
| 7,156,401 | B2 * | 1/2007 | Merklein | F28F 9/0226 165/149 |
| 7,341,098 | B2 * | 3/2008 | Brost | F28F 9/0229 165/149 |
| 7,798,206 | B2 * | 9/2010 | Hirano | F28D 1/05366 165/173 |
| 7,954,543 | B2 * | 6/2011 | Hernandez | F28F 9/0226 165/149 |
| 2006/0070725 | A1 * | 4/2006 | Kroetsch | F28F 9/001 165/149 |
| 2006/0185833 | A1 * | 8/2006 | Brost | F28F 9/0224 165/149 |
| 2007/0163751 | A1 | 7/2007 | Balci et al. | |
| 2007/0261820 | A1 | 11/2007 | Rousseau et al. | |
| 2012/0018135 | A1 * | 1/2012 | Ciaffarafa | B21D 49/00 165/173 |

(Continued)

*Primary Examiner* — Gordon A Jones

(74) *Attorney, Agent, or Firm* — Brooks Kushman P.C.

(57) ABSTRACT

A heat exchanger includes a header and a side plate. The header has a face plate that defines a plurality of orifices. The header has a protrusion that extends outward from the header and down such that a gap is formed between the header and the protrusion. An external portion of the protrusion is configured to break away from the header during thermal expansion. The side plate is disposed adjacent to an array of alternating tubes and fins. Each tube extends into one of the orifices of the plurality of orifices. The side plate has an end that is secured to the external portion of the protrusion.

15 Claims, 6 Drawing Sheets

(56) References Cited

U.S. PATENT DOCUMENTS

| | | | | |
|---|---|---|---|---|
| 2012/0024508 | A1* | 2/2012 | Kroetsch | F28F 9/001 165/173 |
| 2016/0238325 | A1 | 8/2016 | Johnson et al. | |
| 2018/0252481 | A1* | 9/2018 | Tian | F28D 1/05366 |
| 2019/0072341 | A1* | 3/2019 | Singh | F28D 1/05375 |
| 2020/0064084 | A1* | 2/2020 | Tian | F28F 9/001 |

* cited by examiner

HEAT EXCHANGER

TECHNICAL FIELD

The present disclosure relates to heat exchangers, particularly to tube and fin type heat exchangers.

BACKGROUND

Tube and fin heat exchangers may be utilized to transfer heat between a fluid flowing through the tubes of the heat exchanger and air that is being direct across the fins of the heat exchanger.

SUMMARY

A heat exchanger includes a header and a side plate. The header has a face plate that defines a plurality of orifices. The header has a protrusion that extends outward from the header and down such that a gap is formed between the header and the protrusion. An external portion of the protrusion is configured to break away from the header during thermal expansion. The side plate is disposed adjacent to an array of alternating tubes and fins. Each tube extends into one of the orifices of the plurality of orifices. The side plate has an end that is secured to the external portion of the protrusion.

A heat exchanger includes a header, an array of alternating tubes and fins, and a side plate. The header has a face plate, an exterior peripheral wall extending from the face plate, and a protrusion that bends away and over the exterior peripheral wall such that a gap is formed between the exterior peripheral wall and the protrusion. An external portion of the protrusion is configured to break away from the exterior peripheral wall during thermal expansion. Each of the tubes extends into the face plate. The side plate is disposed adjacent to the array of alternating tubes and fins. The side plate has an end that is secured to the external portion of the protrusion.

A heat exchanger includes a header and a side plate. The header has a face plate, an exterior peripheral wall extending from the face plate, and a protrusion that extends away from the exterior peripheral wall along a substantially 180° bend such that a gap is formed between the header and the protrusion. An external portion of the protrusion is configured to break away from the exterior peripheral wall along the bend during thermal expansion. The side plate is disposed adjacent to an array of alternating tubes and fins. An end of the side plate is secured to the external portion of the protrusion.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
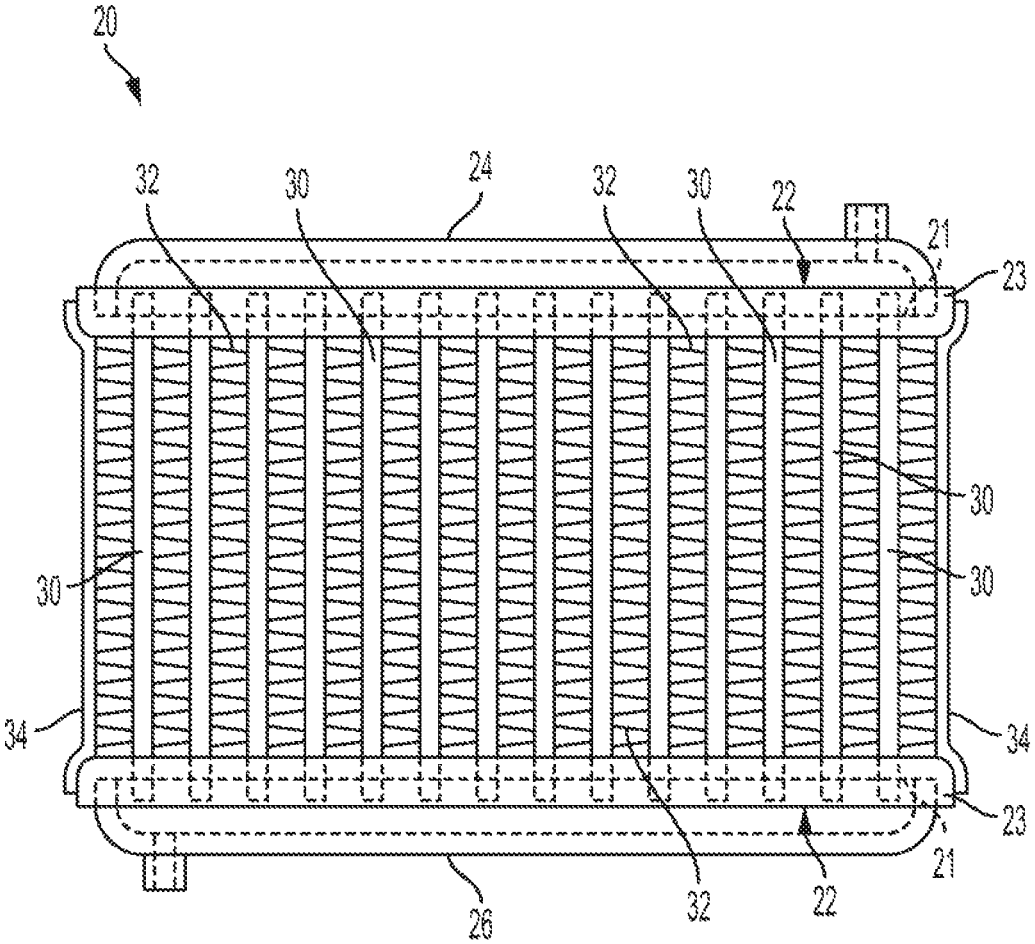
FIG. 1 is a front view of a heat exchanger.
Figure 2:
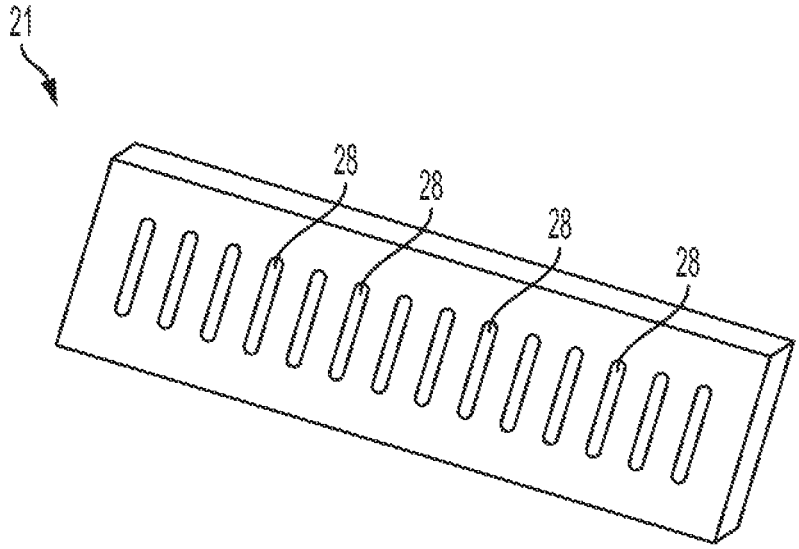
FIG. 2 is a perspective view of a face plate of a header.
Figure 3:
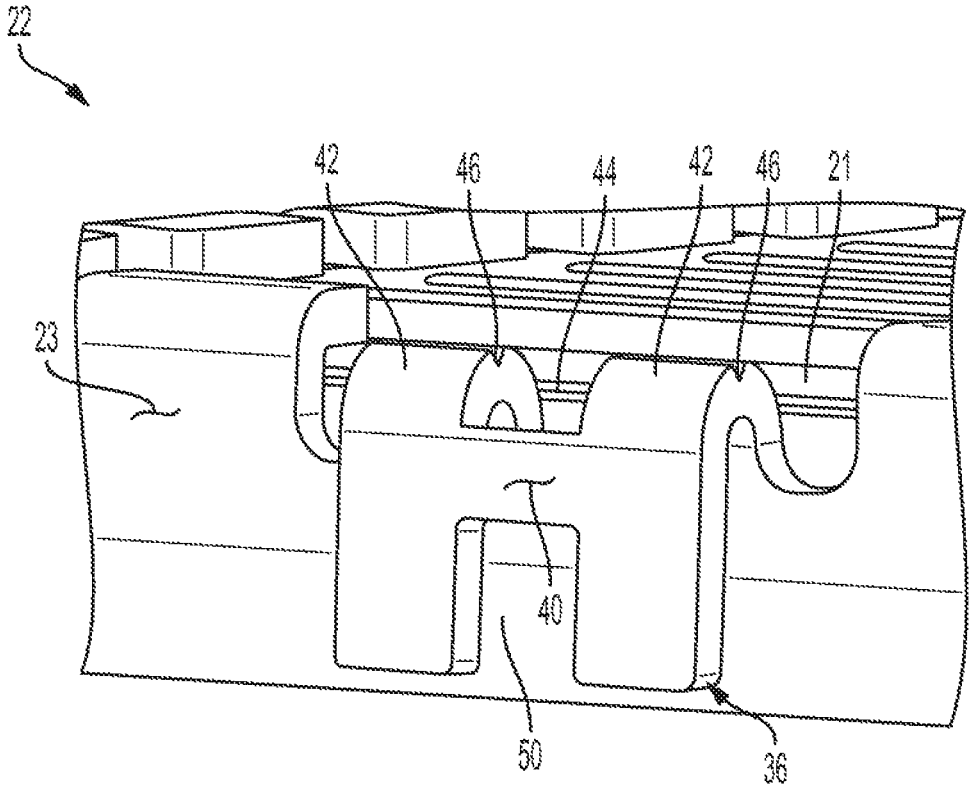
FIG. 3 is a perspective view of a portion of the header including a protrusion that engages a side plate to secure the side plate to the header.
Figure 4:
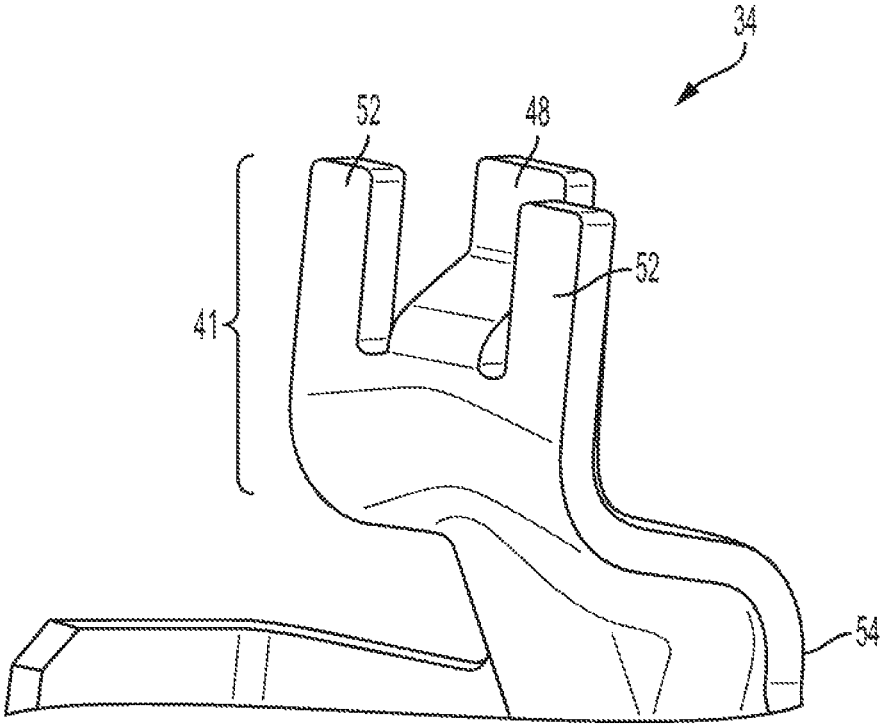
FIG. 4 is a perspective view of a portion of the side plate including an end of the side plate that engages the protrusion to secure the side plate to the header.
Figure 5:
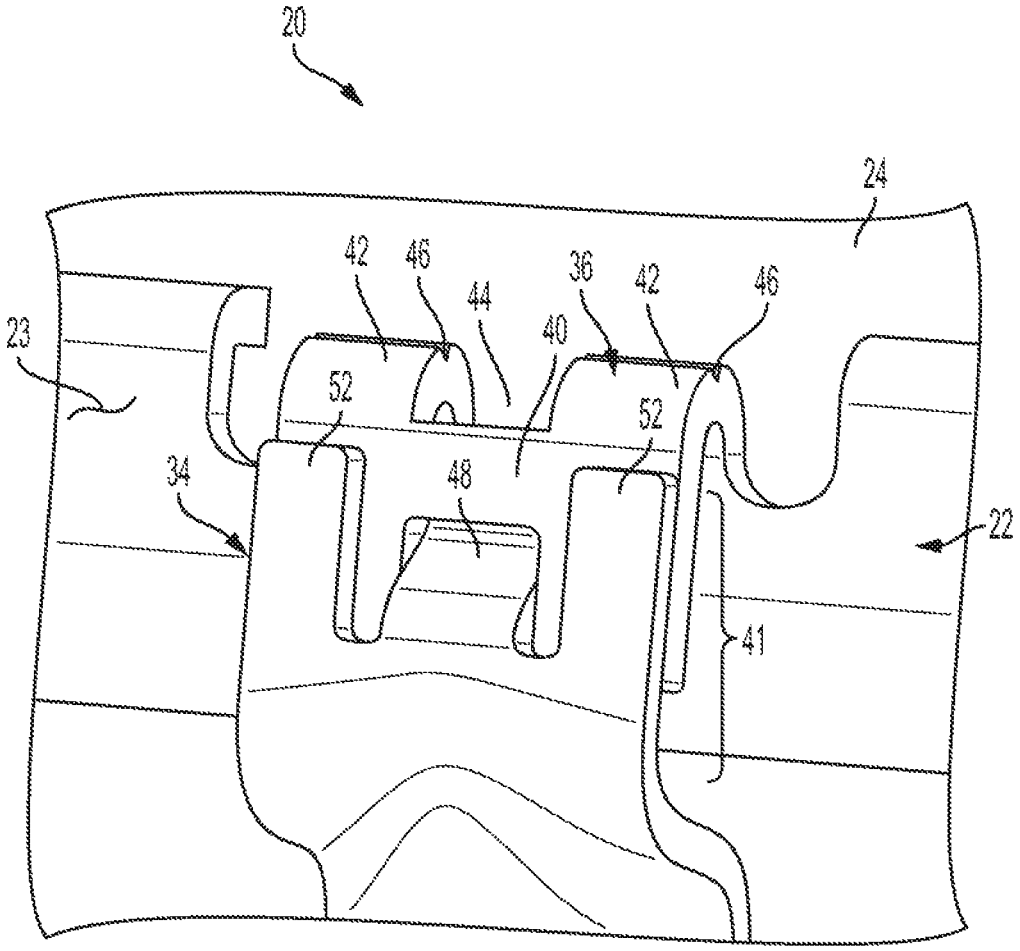
FIG. 5 is a perspective view of the engagement between the protrusion located on the header and the end of the side plate.
Figure 6:
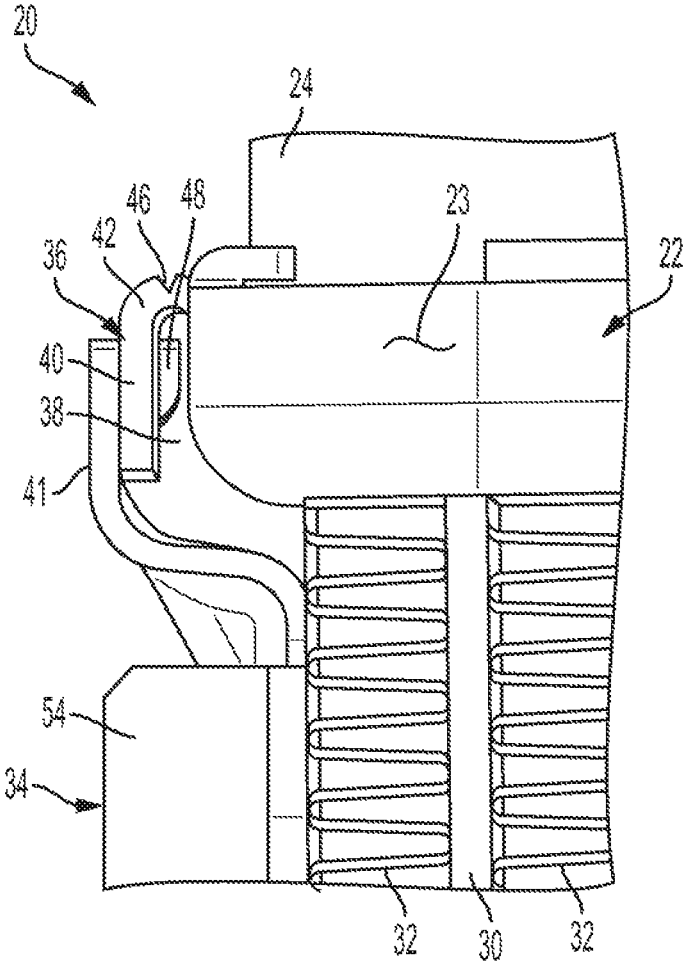
FIG. 6 is a side view of the engagement between the protrusion located on the header and the end of the side plate.

Referring to FIGS. 1 and 2, a heat exchanger 20 and a face plate 21 of a header 22 of the heat exchanger 20 are illustrated, respectively. Please note that FIGS. 1 and 2 are simplified drawings and the respective components described in FIGS. 1 and 2 may have additional features or different geometry than is illustrated in FIGS. 1 and 2. The heat exchanger 20 includes a first header tank 24 and a second header tank 26. A first header 22 is secured to the first header tank 24 and a second header 22 is secured to the second header tank 26. Each header 22 includes a face plate 21 and an exterior peripheral wall 23 that extends from the face plate 21 along a bend. The face plate 21 and the exterior peripheral wall 23 may be made from a common stock component, such as a flat piece of sheet metal. The face plate 21 and the exterior peripheral wall 23 may be substantially perpendicular to each other. Substantially perpendicular may refer to any incremental value that is between exactly perpendicular and 20° from exactly perpendicular.

Each header 22 defines a plurality of orifices 28. More specifically, each header plate 21 of each header 22 defines a plurality of orifices 28. A plurality of tubes 30 extend between the first header tank 24 and the second header tank 26. More specifically, a first end of each of the tubes 30 extends into a respective one of the plurality of orifices 28 of the first header 22 while a second end of each of the tubes 30 extends into a respective one of the plurality of orifices 28 of the second header 22. Each of the plurality of tubes 30 may extend into and may be secured to the headers 22, or more specifically may extend into and may be secured to the face plates 21, by brazing each tube 30 to the headers 22 proximate the respective orifices 28 that the first and second ends of the tubes 30 extend into. The plurality of tubes 30 are configured to channel a coolant, a refrigerant, or any other heat exchanging liquid or gas from the first header tank 24 to the second header tank 26. Coils or fins 32 are disposed between adjacent tubes 30 forming an array of alternating tubes 30 and fins 32. The fins 32 facilitate heat transfer between the liquid or gas that is flowing through the plurality of tubes 30 and air that is being directed across the heat exchanger 20.

A pair of side plates 34 may be disposed on opposing ends of the array of alternating tubes 30 and fins 32. Each side plate 34 may be adjacent to the last set of fins 32 forming the array of alternating tubes 30 and fins 32 (as illustrated in FIG. 1) or may be adjacent to the last tube 30 forming the array of alternating tubes 30 and fins 32. The side plates 34 may extend between the first and second headers 22 and may be secured to the first and second headers 22 by a brazing or welding process.

The heat exchanger 20 and the face plate 21 of a header 22 depicted in FIGS. 1 and 2 are not meant to be limiting. For example, the first header tank 24 and the second header tank 26 are shown to include a single chamber for storing a heat transferring fluid. However, other embodiments that include divider walls within the first header tank 24 and the second header tank 26 that divide the single chamber of the respective tanks into multiple chambers should be construed as disclosed herein. As another example, the header 22 is depicted to define a single row of orifices 28. However, other embodiments where the header 22 defines multiple rows and/or columns of orifices 28 should be construed as disclosed herein. The heat exchanger 20 may be utilized in any system that requires a transfer of heat from a first fluid to a second fluid. For example, the exchanger 20 may be utilized as a radiator or a heater core in an engine cooling system of an automobile. As another example, the heat exchanger may be utilized as an evaporator or as a condenser in an air conditioning system.

One challenge in the design of heat exchangers or radiators is to control the thermal stress at the junctions between the tubes and the header. Such thermal stress occurs when a heat exchanger or radiator is cold followed by introducing a hot fluid into the heat exchanger or radiator (e.g., via opening a thermostat in a radiator of a vehicle). When the hot fluid travels through the radiator, the tubes heat up, causing them to expand. Uneven expansion of the radiator core (i.e., the array of alternating tubes and fins) and/or uneven expansion of the face plates of the headers causes strain, particularly at the brazed joints between the tubes and the header. If the strain in this region becomes too high, it may cause a fatigue crack in the tube, resulting in a leaking radiator. This is particularly a concern for the first and last tubes, which are next to the side plates of the heat exchanger or radiator. When a hot fluid flows through the heat exchanger or radiator, the tube expands, but because the side plate does not come into contact with the hot fluid, it does not expand. This results in the highest thermal stress typically occurring at the outer or last tube of the array of alternating tubes and fins that is next to or adjacent to the side plate.

Design alterations to heat exchangers and radiators may be implemented to reduce thermal stress and strain, including, adjustments to the tube and header interface (such as increasing the thickness of the brazing material joining the tubes to the header), using thicker gage tubes, introducing thermal strain relief features, and introducing, tube stiffeners. However, thermal stress and strain may continue to present a concern along the outer or last tube of the array of alternating tubes and fins. This disclosure seeks to reduce thermal strain by breaking away the side plate from the header after a small number of expansions and contractions to reduce the long-term damage that may be caused to the outer or last tube of the array of alternating tubes and fins of a heat exchanger via thermal expansion and contraction.

In a heat exchanger and particularly in an automotive radiator, the side plate is typically rigidly brazed to the header. In the heat exchanger and/or radiator embodiments described herein, however, the side plate is brazed to a tab or protrusion that extends from the end of the header. This tab or protrusion is designed to break after a small number of expansions and contractions of the tube next to the side plate, in order to decouple the side plate from the header allowing the tube to freely expand and contract once the side plate has broken away. The main functionality of the side plates is to compress the tubes and fins during the brazing process. In addition, the side plates may provide some support to hold the headers or header plates in the correct location. After manufacturing has been completed, the tubes of the heat exchanger or radiator provide sufficient support between the headers. Therefore, allowing the side plates to break away does not result in a significant reduction in the structural integrity of the heat exchanger or radiator.

Referring to FIGS. 3-6, a portion of the header 22 that engages the side plate 34, a portion of the side plate 34 that engages the header 22, and the engagement between the header 22 and the side plate 34 are illustrated. It should be understood that the engagement between the header 22 and the side plate 34 illustrated in FIGS. 5 and 6 may be representative of all four engagements between first and second headers 22 and the two side plates 34 illustrated in FIG. 1. The header 22 includes a tab or protrusion 36 that extends outward from the header 22 and down such that a space or gap 38 is formed between the protrusion 36 and the remainder of the header 22. More specifically, the protrusion 36 may bend away and over the exterior peripheral wall 23 of the header 22 such that the gap 38 is formed between the exterior peripheral wall 23 of the header 22 and the protrusion 36. Even more specifically, the protrusion 36 may extend away from the exterior peripheral wall 23 of the header 22 along a substantially 180° bend such that the gap 38 is formed between the exterior peripheral wall 23 of the header 22 and the protrusion 36. Substantially 180° may refer to any incremental value that is between exactly 180° and 20° from exactly 180°. An external portion 40 of the protrusion 36 is configured to break away from the header 22 during thermal expansion. It should be noted that it may take more than one cycle of thermal expansion for the external portion 40 of the protrusion 36 to break away from the header 22. The side plate 34 has an end 41 that is secured to the external portion 40 of the protrusion 36. Therefore, the external portion 40 of the protrusion 36 and the side plate 34 as a whole are configured to break away from the header 22 during thermal expansion.

The external portion 40 of the protrusion 36 may be configured to break away from the remainder of header 22, or more specifically a remainder of the protrusion 36, along a bend 42 of the protrusion 36 during thermal expansion. The protrusion 36 may include features that weaken the protrusion at a specific location (e.g., bend 42) in order facilitate the breaking away of the external portion 40 at such a specific location during thermal expansion. For example, the protrusion 36 may have a cross-sectional area that is decreased at a specific location relative to the remainder of the protrusion such that the external portion 40 will break away from the header 22 at such a specific location where the cross-sectional is decreased during thermal expansion. A central portion of the bend 42 of the protrusion 36 may define a slot 44 that extends through the protrusion 36. Such a slot 44 will decrease the cross-sectional area of the protrusion 36 along the bend 42, resulting in the external portion 40 breaking away from the header 22 along the bend 42 during thermal expansion. In addition to or in the alternative of the slot 44, the external portion 40 of the protrusion 36 may define a notch 46 that extends across an outer surface of the protrusion 36. More specifically, the notch 46 may be V-shaped and may be defined along the bend 42. Such a notch 46 will decrease the cross-sectional area of the protrusion 36, resulting in the external portion 40 breaking away from the header 22 along notch 46 during thermal expansion.

From a manufacturing perspective, it may also be beneficial to add features that align the side plate 34 with the header 22 so that the side plate 34 will properly compress the tubes 30 and fins 32 during the brazing process. Specifically, the alignment features may include a central tab 48 that extends inward from each end 41 of the side plate 34 and a slot 50 that is defined by the external portion 40 of the protrusion 36. The central tab 48 may be disposed within the slot 50 to align the side plate 34 with the header 22. Each end 41 of the side plate 34 may also include an outer pair of tabs 52 that straddle the central tab 48. The pair of tabs 52 may be brazed to the external portion 40 of the protrusion 36 to secure the side plate 34 to the header 22. Each end 41 of the side plate 34 may also be offset from a central portion 54 of the side plate 34.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A heat exchanger comprising:

a header having a face plate defining a plurality of orifices and having a protrusion that extends outward from the header and down such that a gap is formed between the header and the protrusion, wherein an external portion of the protrusion is configured to break away from the header along a bend of the protrusion during thermal expansion, and wherein a central portion of the bend defines a slot that extends through the protrusion; and a side plate disposed adjacent to an array of alternating tubes and fins, each tube extending into one of the orifices of the plurality of orifices, the side plate having an end that is secured to the external portion of the protrusion.

2. The heat exchanger of claim 1, wherein the external portion of the protrusion defines a notch that extends across an outer surface of the protrusion, and wherein the external portion of the protrusion is configured to break away from the header along the notch.

3. The heat exchanger of claim 2, wherein the notch is V-shaped.

4. The heat exchanger of claim 1, wherein the side plate includes a central tab that extends inward from the end of the side plate, the external portion of the protrusion defines a second slot, and the tab is disposed within the second slot to align the side plate with the header.

5. The heat exchanger of claim 4, wherein the side plate includes an outer pair of tabs that straddle the central tab, and wherein the pair of tabs are brazed to the external portion of the protrusion to secure the side plate to the header.

6. A heat exchanger comprising:

a header having a face plate, an exterior peripheral wall extending from the face plate, and a protrusion that bends away and over the exterior peripheral wall such that a gap is formed between the exterior peripheral wall and the protrusion, wherein an external portion of the protrusion is configured to break away from the exterior peripheral wall along a bend of the protrusion during thermal expansion, and wherein a central portion of the bend defines a slot that extends through the protrusion;

an array of alternating tubes and fins, each of the tubes extending into the face plate; and a side plate disposed adjacent to the array and having an end that is secured to the external portion of the protrusion.

7. The heat exchanger of claim 6, wherein the external portion of the protrusion defines a notch that extends across an outer surface of the protrusion, and wherein the external portion of the protrusion is configured to break away from the exterior peripheral wall along the notch.

8. The heat exchanger of claim 7, wherein the notch is V-shaped.

9. The heat exchanger of claim 6, wherein the side plate includes a central tab that extends inward from the end of the side plate, the external portion of the protrusion defines a second slot, and the tab is disposed within the second slot to align the side plate with the header.

10. The heat exchanger of claim 9, wherein the side plate includes an outer pair of tabs that straddle the central tab, and wherein the pair of tabs are brazed to the external portion of the protrusion to secure the side plate to the header.

11. A heat exchanger comprising:

a header having a face plate, an exterior peripheral wall extending from the face plate, and a protrusion that extends away from the exterior peripheral wall along a substantially 180° bend such that a gap is formed between the exterior peripheral wall and the protrusion, wherein an external portion of the protrusion is configured to break away from the exterior peripheral wall along the bend during thermal expansion, and wherein a central portion of the bend defines a slot that extends through the protrusion; and a side plate that is disposed adjacent to an array of alternating tubes and fins, wherein an end of the side plate is secure to the external portion of the protrusion.

12. The heat exchanger of claim 11, wherein the exterior peripheral wall is substantially perpendicular to the face plate.

13. The heat exchanger of claim 11, wherein the external portion of the protrusion defines a notch that extends across an outer surface of the protrusion, and wherein the external portion of the protrusion is configured to break away from the exterior peripheral wall along the notch.

14. The heat exchanger of claim 13, wherein the notch is V-shaped.

15. The heat exchanger of claim 11, wherein the side plate includes a central tab that extends inward from the end of the side plate, the external portion of the protrusion defines a second slot, and the tab is disposed within the second slot to align the side plate with the header.

* * * * *